US007484828B2

(12) United States Patent
Owaki

(10) Patent No.: US 7,484,828 B2
(45) Date of Patent: Feb. 3, 2009

(54) LIQUID JET HEAD UNIT, MANUFACTURING METHOD THEREOF AND LIQUID JET DEVICE

(75) Inventor: Hiroshige Owaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 479 days.

(21) Appl. No.: 10/927,389

(22) Filed: Aug. 27, 2004

(65) Prior Publication Data

US 2005/0046668 A1 Mar. 3, 2005

(30) Foreign Application Priority Data

Aug. 27, 2003 (JP) ..... 2003-302856
Jul. 23, 2004 (JP) ..... 2004-215538

(51) Int. Cl.
*B41J 2/135* (2006.01)

(52) U.S. Cl. ..... 347/44

(58) Field of Classification Search ..... 347/40–42, 347/71, 85–86, 70, 72, 49, 108
See application file for complete search history.

(56) References Cited

U.S. PATENT DOCUMENTS 5,907,339 A * 5/1999 Evans et al. ..... 347/54
5,971,522 A * 10/1999 Ono et al. ..... 347/40
6,863,390 B2 * 3/2005 Arai et al. ..... 347/94
2002/0122093 A1 * 9/2002 Otsuka ..... 347/40
2002/0135636 A1 * 9/2002 Miyakawa et al. ..... 347/45
2003/0090540 A1 * 5/2003 Shimizu ..... 347/49
2003/0128254 A1 * 7/2003 Ison et al. ..... 347/49
2004/0046832 A1 * 3/2004 Kuwahara ..... 347/43
2005/0001877 A1 1/2005 Chikanawa et al.

FOREIGN PATENT DOCUMENTS

CN 1078537 C 1/2002
CN 1401484 A 3/2003
JP 2002-160376 A 6/2002
JP 2003-145791 A 5/2003
JP 2004-284255 10/2004

* cited by examiner

*Primary Examiner*—Matthew Luu
*Assistant Examiner*—Lisa M Solomon
(74) *Attorney, Agent, or Firm*—Sughrue Mion, PLLC

(57) ABSTRACT

Provided are a liquid jet head unit, a manufacturing method thereof and a liquid jet apparatus, the liquid jet head unit being capable of preventing paper jams and deformation of a cover head, preventing a liquid from remaining on a liquid droplet ejecting surface and improving positioning accuracy of nozzle arrays and print quality. A liquid jet head unit includes: a liquid jet head 220 having nozzle arrays including arranged nozzle orifices which eject liquid droplets; a head case 230 fixed to a liquid supply port side of the liquid jet head 220; a cover head 240 provided on a liquid droplet ejecting surface side of the liquid jet head; and a fixing plate 250 between the liquid jet head 220 and the cover head 240, which has a junction 252 that defines exposure openings 251 having the nozzle orifices exposed therein and is joined to at least both ends of the nozzle arrays on the liquid droplet ejecting surface. In the liquid jet head unit, by joining the liquid droplet ejecting surface of the liquid jet head 220 and the fixing plate 250, a plurality of the liquid jet heads 220 are positioned and fixed to a common fixing plate.

19 Claims, 9 Drawing Sheets

LIQUID JET HEAD UNIT, MANUFACTURING METHOD THEREOF AND LIQUID JET DEVICE

BACKGROUND OF THE INVENTION

1. Field of the Invention

The present invention relates to a liquid jet head unit including a liquid jet head ejecting liquids to be injected, to a manufacturing method thereof, and to a liquid jet device. Particularly, the present invention relates to an ink-jet recording head unit including an ink-jet recording head in which a part of pressure generating chambers which communicate with nozzle orifices ejecting ink droplets is formed of a vibration plate, piezoelectric elements are provided on this vibration plate and the ink droplets are ejected by displacement of the piezoelectric elements. In addition, the present invention relates to a method for manufacturing the ink-jet recording head unit and an ink-jet recording apparatus.

2. Description of the Related Art

An ink-jet recording apparatus such as an ink-jet printer and a plotter has an ink-jet recording head unit (hereinafter referred to as a head unit) which includes an ink-jet recording head capable of ejecting ink stored in an ink reservoir such as an ink cartridge and an ink tank, as ink droplets.

The head unit includes: an ink-jet recording head which has nozzle arrays including arranged nozzle orifices; a head case fixed to an ink supply port side of the ink-jet recording head; and a cover head which protects an ink droplet ejecting surface side of the ink-jet recording head. The cover head has: a window frame part having an open window portion which is provided on the ink droplet ejecting surface side of the ink-jet recording head and exposes the nozzle orifices; and a sidewall part which is formed to be bent toward a side face of the ink-jet recording head from the window frame part. The cover head is fixed to the ink-jet recording head by joining the sidewall part to the side face of the ink-jet recording head (for example, refer to Japanese Patent Laid-Open No. 2002-160376 (Page 4, FIG. 3)).

Moreover, there has been proposed a head unit in which a cover head is fixed to a surface of a member different from nozzles of an ink-jet recording head so that the ink-jet recording head is fixed by use of the cover head (for example, refer to Japanese Patent Laid-Open No. 2003-145791 (Page 6, FIGS. 6 and 7)).

However, in an ink-jet recording head including multiple nozzle arrays in which nozzle orifices are arranged, if multiple arrays of nozzle orifices are provided in one ink-jet recording head, there arises a problem that yield is reduced.

Moreover, if there is a space between the ink droplet ejecting surface and the cover head, a difference in level between the ink droplet ejecting surface and the cover head is increased. Thus, even if the ink droplet ejecting surface is wiped, there is a problem that this difference in level causes ink to remain on the ink droplet ejecting surface and the ink enters the space. Furthermore, if there is a space between the ink droplet ejecting surface and the cover head, there is a problem that media to be recorded on such as paper get into the space to cause occurrence of paper jams and deformation of the cover head.

Moreover, when multiple nozzle arrays are provided by using a plurality of ink-jet recording heads in a head unit, there arises the following problem. Specifically, in fixing the plurality of ink-jet recording heads to a retaining member such as a cartridge case in which ink cartridges are mounted, relative positioning of adjacent nozzle arrays cannot be accurately performed. Moreover, when a retaining member retaining a head unit is mounted on a carriage which moves in a scanning direction of a medium to be recorded on, it is required to perform positioning of the retaining member and the carriage in order to perform relative positioning of the carriage and nozzle arrays. Moreover, there is a problem that positioning of the nozzle arrays with respect to the carriage cannot be accurately performed.

Furthermore, when the cover head is joined to a surface of a member different from the nozzles, there arises the following problem. Specifically, an operation of positioning the cover head and the nozzle arrays and joining them is difficult. Moreover, highly accurate positioning thereof cannot be performed.

Note that such problems as described above exist not only in the ink-jet recording head unit including the ink-jet recording head ejecting ink but also in a liquid jet head unit including another liquid jet head ejecting a substance other than ink, as a matter of course.

SUMMARY OF THE INVENTION

In consideration of the circumstances as described above, it is an object of the present invention to provide a liquid jet head unit capable of preventing paper jams and deformation of a cover head, preventing a liquid from remaining on a liquid droplet ejecting surface and improving positioning accuracy of nozzle arrays and print quality. Moreover, it is the object of the present invention to provide a method for manufacturing the liquid jet head unit and a liquid jet device.

A first aspect of the present invention for achieving the foregoing object is a liquid jet head unit which includes: a liquid jet head having nozzle arrays including arranged nozzle orifices which eject liquid droplets; a head case fixed to a liquid supply port side of the liquid jet head; a cover head provided on a liquid droplet ejecting surface side of the liquid jet head; and a fixing plate between the liquid jet head and the cover head, which has a junction that defines exposure openings having the nozzle orifices exposed therein and is joined to at least both ends of the nozzle arrays on the liquid droplet ejecting surface. In the liquid jet head unit, by joining the liquid droplet ejecting surface of the liquid jet head and the fixing plate, a plurality of liquid jet heads are positioned and fixed to a common fixing plate.

In the first aspect, it is possible to easily and accurately perform relative positioning of a plurality of nozzle arrays by use of the fixing plate and to perform positioning and joining of the fixing plate and the plurality of liquid jet heads.

A second aspect of the present invention is the liquid jet head unit according to the first aspect, characterized in that the junction has a fixing frame part provided along a periphery of the liquid droplet ejecting surface.

In the second aspect, since the frame part of the fixing plate blocks the periphery side of the liquid droplet ejecting surface, it is possible to prevent liquids from running around the liquid jet heads.

A third aspect of the present invention is the liquid jet head unit according to the first or second aspect, characterized in that the junction has a fixing beam part of which is provided to extend between the adjacent liquid jet heads and divides the exposure opening.

In the third aspect, by use of the fixing beam part of the fixing plate, it is possible to prevent the liquids from running around the liquid jet heads from a space between the adjacent liquid jet heads. In addition, it is possible to prevent deterioration of and damage to the liquid jet heads due to the liquids.

A fourth aspect of the present invention is the liquid jet head unit according to any one of the first to third aspects, characterized in that, in the liquid jet head, pin insertion holes are provided, into which pins for positioning in assembly of individual members included in the liquid jet head are inserted, and the fixing plate seals the pin insertion holes.

In the fourth aspect, it is possible to prevent liquids from entering into the pin insertion holes and to surely prevent deterioration of and damage to the liquid jet heads due to the liquids.

A fifth aspect of the present invention is the liquid jet head unit according to any one of the first to fourth aspects, characterized in that the fixing plate is made of a metal material.

In the fifth aspect, since the fixing plate is made of the metal material, the fixing plate can be grounded.

A sixth aspect of the present invention is the liquid jet head unit according to any one of the first to fifth aspects, characterized in that the cover head is provided without being joined to a surface of the fixing plate, which is opposite the liquid jet head.

In the sixth aspect, even if the cover head is not joined to the fixing plate, it is possible to prevent the liquids from running around the liquid jet heads by use of the fixing plate.

A seventh aspect of the present invention is the liquid jet head unit according to any one of the first to fifth aspects, characterized in that the cover head is joined to at least both ends of the nozzle arrays on a surface of the fixing plate, which is opposite the liquid jet head.

In the seventh aspect, it is possible to reduce a difference in level between the cover head and the fixing plate and to surely prevent the liquids from remaining on the liquid droplet ejecting surface even if wiping of the liquid droplet ejecting surface, a suction operation and the like are performed.

An eighth aspect of the present invention is the liquid jet head unit according to any one of the first to seventh aspects, characterized in that the cover head has a sidewall part provided to extend to a peripheral portion of the liquid droplet ejecting surface.

In the eighth aspect, by use of the sidewall part, it is possible to prevent liquids from running around the liquid jet heads from peripheries thereof. In addition, it is possible to prevent deterioration of and damage to the liquid jet heads due to the liquids.

A ninth aspect of the present invention is the liquid jet head unit according to the eighth aspect, characterized in that the sidewall part is provided across the peripheral portion of the liquid droplet ejecting surface.

In the ninth aspect, it is possible to surely prevent liquids from running around to peripheries of the liquid jet heads.

A tenth aspect of the present invention is the liquid jet head unit according to any one of the first to ninth aspects, characterized in that fixing holes for positioning and fixing the cover head to another member are provided in the cover head, and the cover head and the liquid jet heads are joined together by positioning the fixing holes and the plurality of nozzle arrays.

In the tenth aspect, by positioning and fixing the fixing holes and the plurality of nozzle arrays, it is possible to easily and accurately perform positioning of the plurality of nozzle arrays and the other member which fixes the cover head.

An eleventh aspect of the present invention is the liquid jet head unit according to the tenth aspect, characterized in that the liquid jet head unit includes a retaining member which retains the head case and the fixing holes of the cover head are positioned and fixed to the retaining member.

In the eleventh aspect, it is possible to accurately perform positioning of the retaining member and the plurality of nozzle arrays.

A twelfth aspect of the present invention is the liquid jet head unit according to the tenth aspect, characterized in that the liquid jet head unit includes a retaining member which retains the head case and is fixed to a carriage moving in a scanning direction and the fixing holes of the cover head are positioned and fixed to the carriage.

In the twelfth aspect, it is possible to accurately perform positioning of the carriage and the plurality of nozzle arrays and to improve print quality.

A thirteenth aspect of the present invention is the liquid jet head unit according to any one of the first to twelfth aspects, characterized in that a water-repellent film is provided on the liquid droplet ejecting surface of the liquid jet head.

In the thirteenth aspect, since the water-repellent film is provided on the liquid droplet ejecting surface, it is possible to improve liquid repellency and to prevent contamination of the liquid droplet ejecting surface.

A fourteenth aspect of the present invention is the liquid jet head unit according to the thirteenth aspect, characterized in that the water-repellent film is formed only in a region exposed by the exposure opening of the liquid droplet ejecting surface.

In the fourteenth aspect, by use of the water-repellent film, it is possible to join the cover head and the liquid droplet ejecting surface without deteriorating a bonding property therebetween.

A fifteenth aspect of the present invention is the liquid jet head unit according to any one of the first to fourteenth aspects, characterized in that the fixing plate is made of a flat plate.

In the fifteenth aspect, since the liquid jet heads are positioned and fixed to the fixing plate made of the flat plate, it is possible to easily and accurately perform positioning of the nozzle arrays without obstructing handling of the liquid jet heads. Moreover, by fixing the liquid jet heads to the fixing plate made of the flat plate so as to abut thereon, positioning of liquid droplet ejecting directions of the plurality of liquid jet heads is performed. Thus, it is not required to perform relative positioning of ink droplet ejecting directions of the plurality of liquid jet heads. Moreover, it is possible to surely prevent failure of landing positions of liquid droplets.

A sixteenth aspect of the present invention is a liquid jet device including the liquid jet head unit according to any one of the first to fifteenth aspects.

In the sixteenth aspect, it is possible to realize a liquid jet device with improved print quality and reliability.

A seventeenth aspect of the present invention is a method for manufacturing a liquid jet head unit, including the steps of: positioning a liquid jet head, which has nozzle arrays including arranged nozzle orifices ejecting liquid droplets and has its liquid supply port side fixed to a head case, to a fixing plate which defines an exposure opening, in which the nozzle orifices are exposed, and has a junction joined to at least both ends of the nozzle arrays on a liquid droplet ejecting surface of the liquid jet head; joining the junction to the liquid droplet ejecting surface; positioning and fixing a plurality of the liquid jet heads to the fixing plate in common; and providing a cover head on the liquid droplet ejecting surface side.

In the seventeenth aspect, it is possible to accurately position the fixing plate and the plurality of nozzle arrays and to join them together.

DESCRIPTION OF THE EMBODIMENTS

The present invention will be described in detail below based on embodiments.

Embodiment 1

Figure 1:
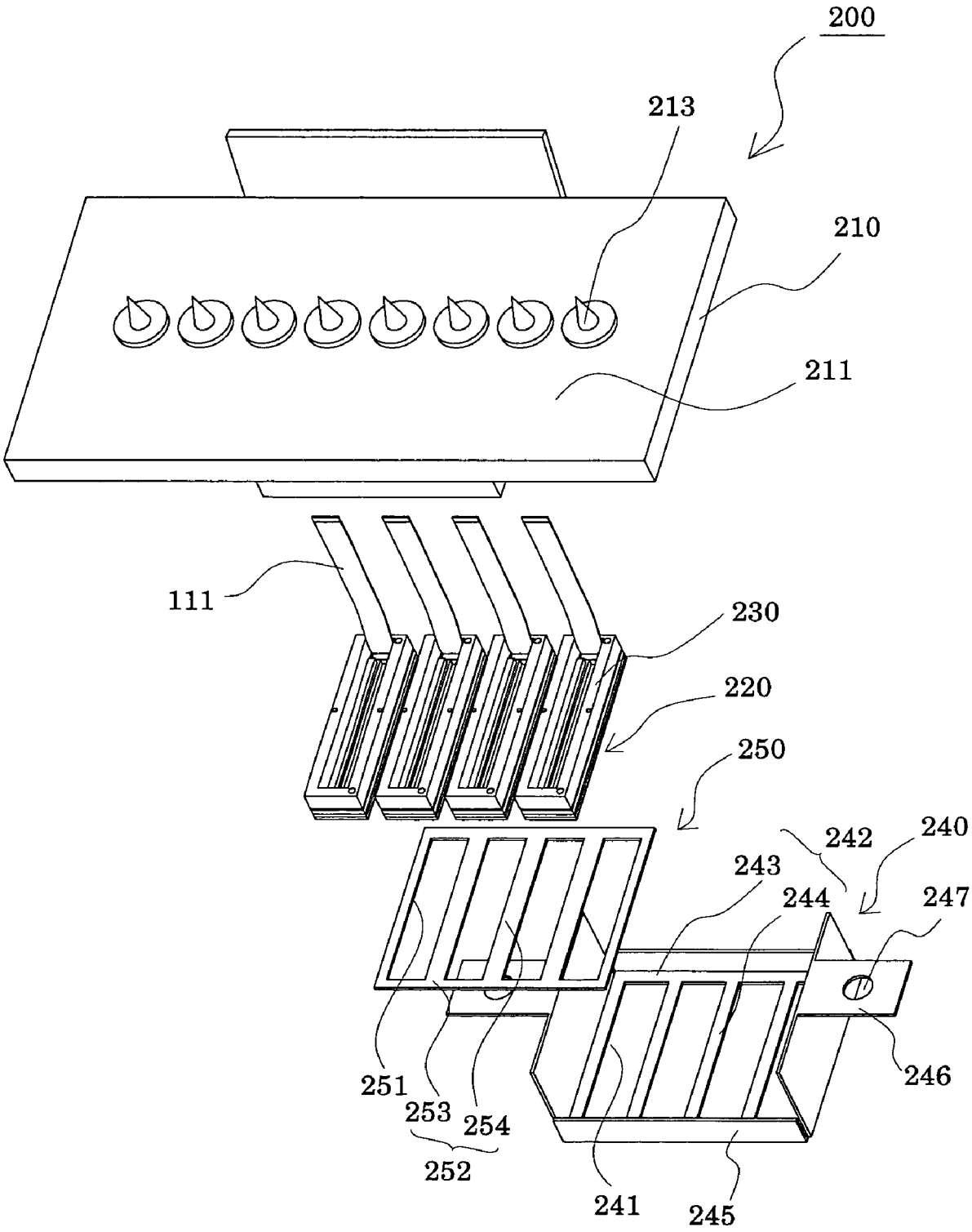
FIG. 1 is an exploded perspective view of a head unit according to embodiment 1.
Figure 2:
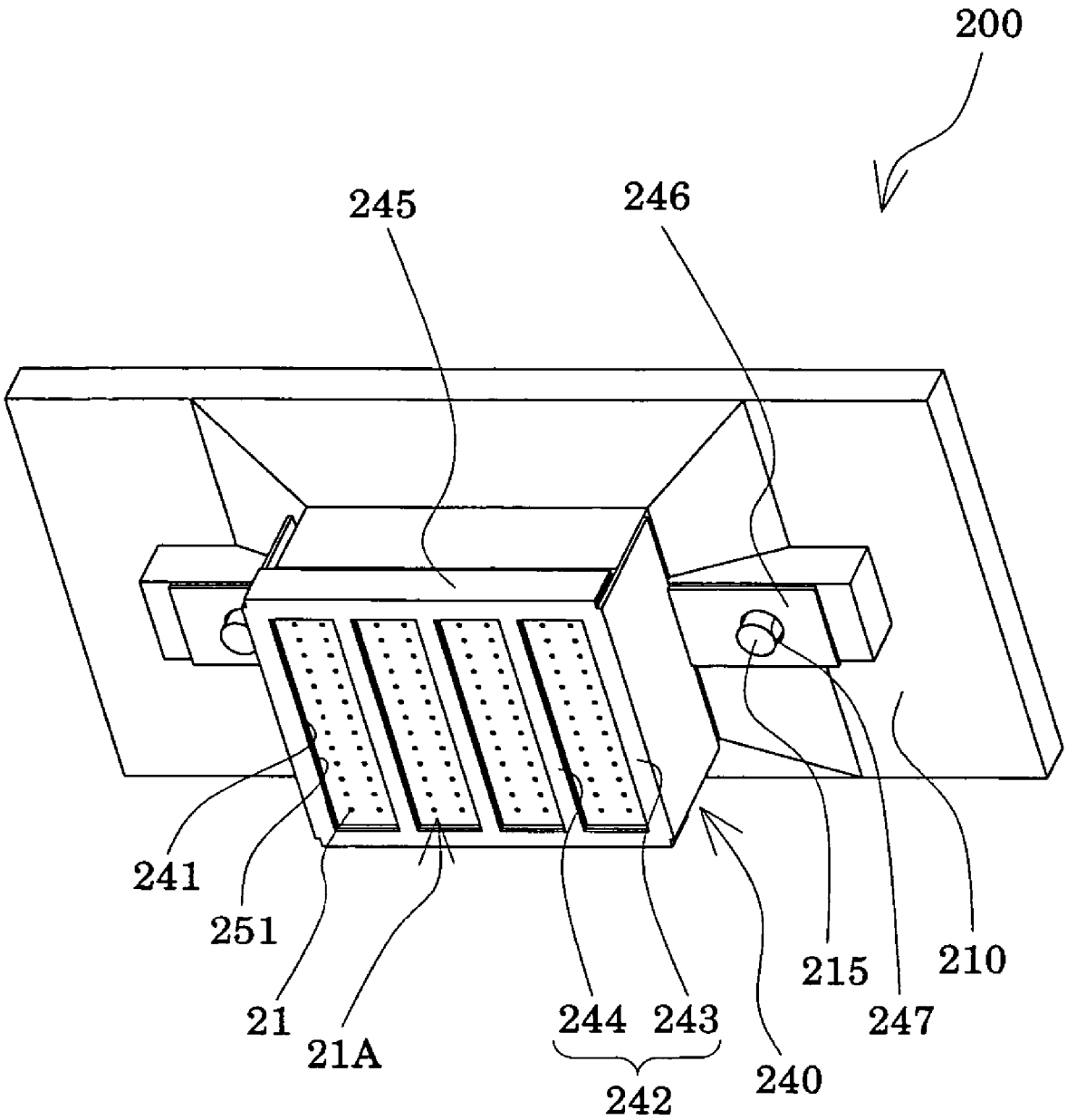
FIG. 2 is a perspective assembly view of the head unit according to embodiment 1.
Figure 3:
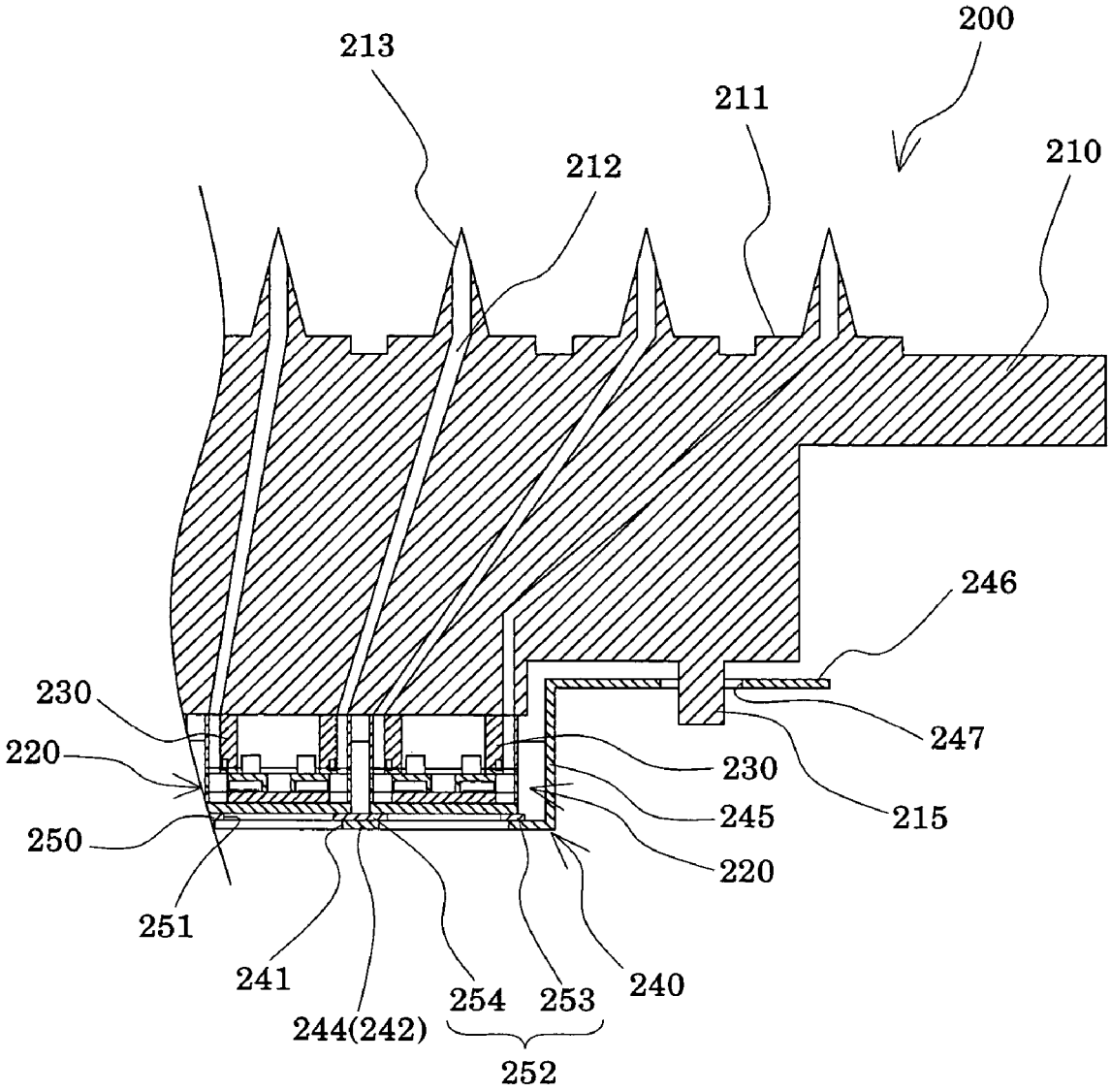
FIG. 3 is a cross-sectional view of main part of the head unit according to embodiment 1.

FIG. 1 is an exploded perspective view showing an ink-jet recording head unit according to embodiment 1 of the present invention. FIG. 2 is a perspective assembly view of the ink-jet recording head unit. FIG. 3 is a cross-sectional view of main part of the ink-jet recording head unit. As shown in FIG. 1, a cartridge case 210 that is a retaining member included in an ink-jet recording head unit 200 (hereinafter referred to as the head unit 200) has a cartridge mounting part 211 in which ink cartridges (not shown) which are ink supply means are mounted, respectively. For example, in this embodiment, the ink cartridges are formed of separate bodies filled with a black ink and three color inks. In the cartridge case 210, the ink cartridges of the respective colors are mounted. Moreover, in a bottom of the cartridge case 210, as shown in FIG. 3, a plurality of ink communicating paths 212 are provided. Specifically, each of the ink communicating paths 212 has its one end open to each of cartridge mounting parts 211 and has its other end open to a head case side to be described later. Furthermore, in an opening of the ink communicating path 212 of the cartridge mounting part 211, an ink supply needle 213 which is inserted into an ink supply port of the ink cartridge is fixed by means of a filter (not shown) which is formed in the ink communicating path 212 in order to remove air bubbles and foreign matter in the ink.

Moreover, at the bottom side of the cartridge case 210 described above, a plurality of piezoelectric elements 300 are provided, and a head case 230, to which an ink-jet recording head 220 is fixed on an end face of the head case 230 opposite the cartridge case 210 side, is also provided. The ink-jet recording head 220 ejects ink droplets from nozzle orifices 21 according to drive of the piezoelectric elements 300. In this embodiment, a plurality of the ink-jet recording heads 220 ejecting inks of the respective colors of the ink cartridges are provided so as to correspond to each of the ink colors. In addition, a plurality of the head cases 230 are also provided so as to correspond to the respective ink-jet recording heads 220 and separate from each other.

Figure 4:
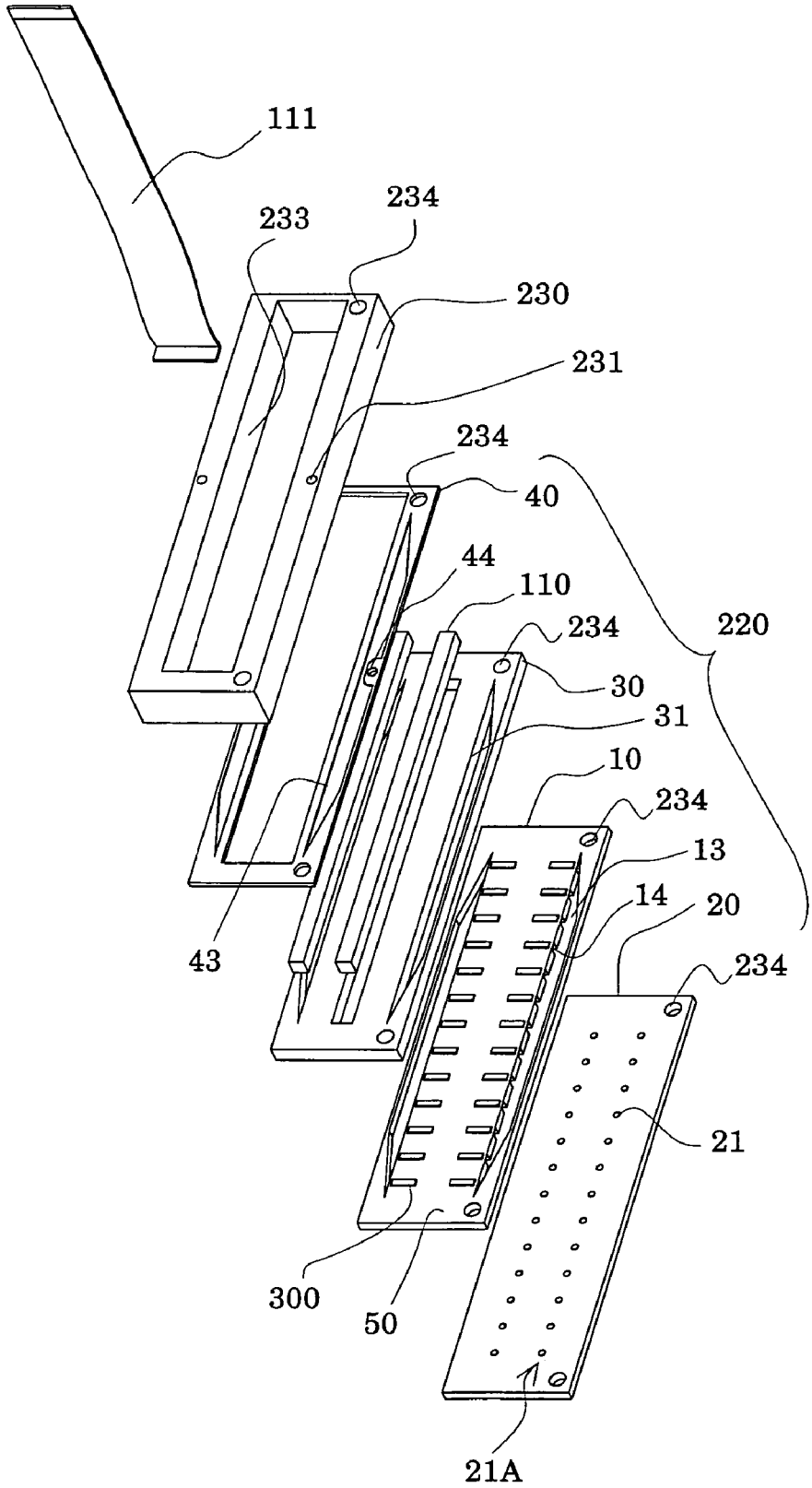
FIG. 4 is an exploded perspective view of the main part of the head unit according to embodiment 1.
Figure 5:
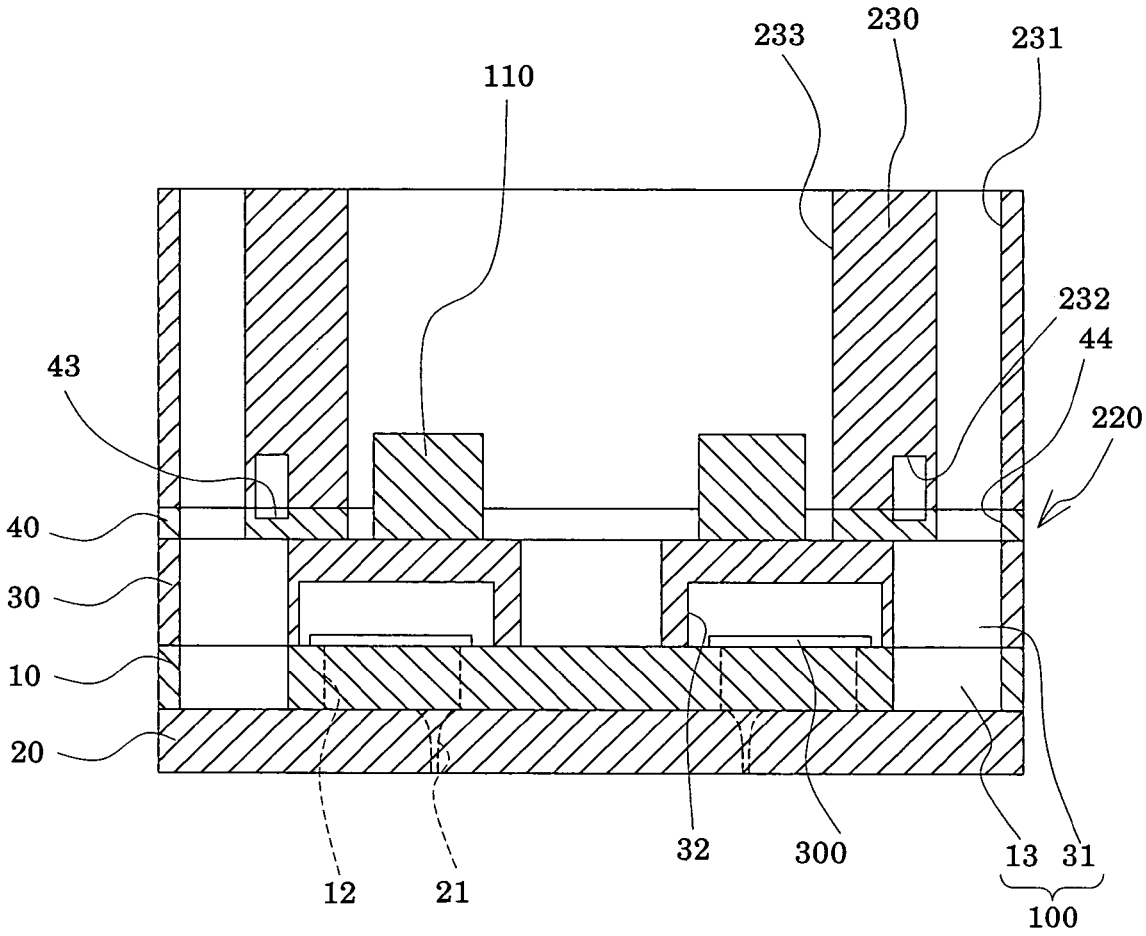
FIG. 5 is a cross-sectional view of a head case and a recording head according to embodiment 1.

Here, description will be given of the ink-jet recording head 220 and the head case 230 according to this embodiment, which are mounted on the cartridge case 210. FIG. 4 is an exploded perspective view of the ink-jet recording head and the head case. FIG. 5 is a cross-sectional view of the ink-jet recording head and the head case. As shown in FIGS. 4 and 5, in this embodiment, a passage-forming substrate 10 included in the ink-jet recording head 220 is made of a single crystal silicon substrate and, on one surface thereof, an elastic film 50 made of silicon dioxide, which is previously formed by thermal oxidation, is formed. In this passage-forming substrate 10, two rows of pressure generating chambers 12 are arranged in a width direction of the substrate by performing anisotropic etching of the substrate from the other surface thereof. Specifically, the pressure generating chambers 12 are separated by use of a plurality of compartment walls. Moreover, on the outside in a longitudinal direction of the pressure generating chambers 12, a communicating portion 13 is formed, which communicates with a reservoir portion 31 provided in a reservoir forming plate 30 to be described later, and which forms a reservoir 100 to be a common ink chamber of the pressure generating chambers 12. The communicating portion 13 communicates with one end portions in the longitudinal direction of the pressure generating chambers 12 via ink supply paths 14, respectively.

Moreover, at an open face side of the passage-forming substrate 10, a nozzle plate 20 having nozzle orifices 21 drilled therein is fixed by use of an adhesive, a thermal welding film or the like, the nozzle orifices 21 communicating with the ink supply paths 14 of the respective pressure generating chambers 12 at the opposite side. Specifically, in this embodiment, two nozzle arrays 21A having the arranged nozzle orifices 21 are provided in one ink-jet recording head. Note that the nozzle plate 20 is made of glass ceramics, a single crystal silicon substrate, stainless steel or the like, which has a thickness of, for example, 0.01 to 1 mm and a coefficient of linear expansion of 2.5 to 4.5 [$10^{-6}$/° C.], for example, at 300' or less.

Meanwhile, on the elastic film 50 at the side opposite the open face of the passage-forming substrate 10, the piezoelectric elements 300 are formed. Specifically, each of the piezoelectric elements 300 is formed by sequentially stacking a lower electrode film made of metal, a piezoelectric layer made of lead-zirconate-titanate (PZT) or the like, and an upper electrode film made of metal. On the passage-forming substrate 10 on which the piezoelectric elements 300 described above are formed, the reservoir forming plate 30 having the reservoir portion 31 which forms at least a part of the reservoir 100 is joined. In this embodiment, this reservoir portion 31 is formed across a width direction of the pressure generating chambers 12 while penetrating the reservoir forming plate 30 in its thickness direction. Accordingly, the reservoir portion 31 communicates with the communicating portion 13 of the passage-forming substrate 10 as described above and forms the reservoir 100 to be a common ink chamber of the pressure generating chambers 12.

Moreover, in a region of the reservoir forming plate 30 facing the piezoelectric element 300, a piezoelectric element holding portion 32 having a space without inhibiting movement of the piezoelectric element 300 is provided. As the reservoir forming plate 30 described above, glass, ceramic, metal, plastic and the like can be used. However, it is preferable to use a material having approximately the same coefficient of thermal expansion as that of the passage-forming substrate 10. In this embodiment, the reservoir forming plate 30 is formed by use of a single crystal silicon substrate that is the same material as that of the passage-forming substrate 10.

Furthermore, on the reservoir forming plate 30, a drive IC 110 for driving each of the piezoelectric elements 300 is provided. Respective terminals of the drive IC 110 are connected to draw-out wirings which are drawn out from individual electrodes of the respective piezoelectric elements 300 via an unillustrated bonding wire or the like. Accordingly, the terminals of the drive IC 110 are connected to the outside through an external wiring 111 such as a flexible print cable (FPC) as shown in FIG. 1. Thus, various signals such as print signals are received through the external wiring 111 from the outside.

Moreover, on the reservoir forming plate 30 as described above, a compliance plate 40 is joined. In a region of the compliance plate 40 facing the reservoir 100, an ink introducing port 44 for supplying ink to the reservoir 100 is formed while penetrating the compliance plate 40 in its thickness direction. Moreover, a region other than the ink introducing port 44 in the region of the compliance plate 40 facing the reservoir 100 is a flexible portion 43 formed to be thin in the thickness direction. The reservoir 100 is sealed by the flexible portion 43. This flexible portion 43 gives compliance inside the reservoir 100.

As described above, the ink-jet recording head 220 of this embodiment is formed of four plates including the nozzle plate 20, the passage-forming substrate 10, the reservoir forming plate 30 and the compliance plate 40. On the compliance plate 40 of the ink-jet recording head 220 as described above, the head case 230 is provided. In the head case 230, an ink supply communicating path 231 is provided, which communicates with the ink introducing port 44 and the ink communicating path 212 of the cartridge case 210 and supplies ink from the cartridge case 210 to the ink introducing port 44. In this head case 230, a concave portion 232 is formed in a region facing the flexible portion 43. Thus, the flexible portion 43 is appropriately subjected to flexible deformation. Moreover, in the head case 230, a drive IC holding portion 233 is provided, which penetrates the head case 230 in its thickness direction in a region facing the drive IC 110 provided on the reservoir forming plate 30. The external wiring 111 is inserted into the drive IC holding portion 233 and connected to the drive IC 110.

The ink-jet recording head 220 of this embodiment as described above takes in the ink from the ink cartridge from the ink introducing port 44 through the ink communicating path 212 and the ink supply communicating path 231 and fills the inside from the reservoir 100 up to the nozzle orifices 21 with the ink. Thereafter, in accordance with a record signal from the drive IC 110, voltages are applied to the respective piezoelectric elements 300 corresponding to the pressure generating chambers 12. Accordingly, the elastic film 50 and the piezoelectric elements 300 are subjected to flexible deformation. Thus, pressures in the pressure generating chambers 12 are increased and ink droplets are ejected from the nozzle orifices 21.

In the each of members constituting the ink-jet recording head 220 as described above and the head case 230, pin insertion holes 234, into which pins for positioning the individual members in assembly are inserted, are provided at two corners. Accordingly, the individual members are joined while performing relative positioning of the members by inserting the pins into the pin insertion holes 234. Thus, the ink-jet recording head 220 and the head case 230 are integrally formed.

Note that the ink-jet recording head 220 described above is manufactured in the following manner. Specifically, a number of chips are simultaneously formed on one piece of silicon wafer and the nozzle plate 20 and the compliance plate 40 are bonded together to be integrated. Thereafter, the silicon wafer is divided for each passage-forming substrate 10 of one chip size as shown in FIG. 4.

Four of such ink-jet recording heads 220 and head cases 230 are fixed to the cartridge case 210 described above at predetermined intervals in a direction of arrangement of the nozzle arrays 21A. Specifically, in the head unit 200 of this embodiment, 8 of the nozzle arrays 21A are provided. As described above, by use of a plurality of the ink-jet recording heads 220, multiple nozzle arrays 21A including the arranged nozzle orifices 21 are provided. Thus, compared to the case where a number of the nozzle arrays 21A are formed in one ink-jet recording head 220, reduction in yield can be prevented. Moreover, by use of a plurality of the ink-jet recording heads 220 in order to realize multiple nozzle arrays 21A, the number of the ink-jet recording heads 220 which can be formed out of one piece of silicon wafer can be increased. Thus, wasted regions of the silicon wafer can be reduced and manufacturing costs can be reduced.

Moreover, as shown in FIGS. 1 and 3, the four ink-jet recording heads 220 as described above are positioned and retained by a common fixing plate 250 which is joined to ink droplet ejecting surfaces of the plurality of ink-jet recording heads 220. The fixing plate 250 is made of a flat plate and includes exposure openings 251, in which the nozzle orifices 21 are exposed, and a junction 252 which defines the exposure openings 251 and is joined to at least both ends of the nozzle arrays 21A on the ink droplet ejecting surfaces of the ink-jet recording heads 220.

In this embodiment, the junction 252 includes: a fixing frame part 253 provided along a periphery of the ink droplet ejecting surfaces across the plurality of ink-jet recording heads 220; and fixing beam parts 254 which are provided to extend between the adjacent ink-jet recording heads 220 and divide the exposure openings 251. The junction 252 formed of the fixing frame part 253 and the fixing beam parts 254 is simultaneously joined to the ink droplet ejecting surfaces of the plurality of ink-jet recording heads 220. Moreover, the fixing frame part 253 of the junction 252 is formed so as to seal the pin insertion holes 234 for positioning the individual members in manufacturing the ink-jet recording head 220.

As a material of the fixing plate 250 as described above, for example, metal such as stainless steel, glass ceramics, a single crystal silicon substrate and the like are enumerated. Note that, for the fixing plate 250, in order to prevent deformation thereof due to a difference in thermal expansion with the nozzle plate 20, it is preferable to use a material having the same coefficient of thermal expansion with that of the nozzle plate 20. For example, when the nozzle plate 20 is formed of a single crystal silicon substrate, it is preferable that the fixing plate 250 is formed of a single crystal silicon substrate.

Moreover, it is preferable that the fixing plate 250 is formed to be thin, and that the fixing plate 250 is formed to be thinner than a cover head 240 to be described later. This is because, for example, if the fixing plate 250 is thick, a distance between the nozzle orifice 21 of the ink-jet recording head 220 and an alignment mark 401 of a positioning jig 400 is increased and it becomes difficult to improve positioning accuracy. In addition, when the ink droplet ejecting surface of the nozzle plate 20 is wiped, the ink is likely to remain between the fixing beam parts 254 and the like. Specifically, by forming the fixing plate 250 to be thin, the distance between the nozzle orifice 21 of the ink-jet recording head 220 and the alignment mark 401 of the positioning jig 400 can be shortened and the positioning can be easily and accurately performed. In addition, it is possible to prevent the ink from remaining on the ink droplet ejecting surface when the wiping is performed. Note that, in this embodiment, the fixing plate 250 is formed to have a thickness of 0.1 mm. Moreover, junction of the fixing plate 250 and the nozzle plate 20 is not particularly limited. For example, the two members are joined together by use of a thermosetting epoxy adhesive, a UV cure adhesive and the like.

As described above, the fixing plate 250 seals spaces between the adjacent ink-jet recording heads 220 by use of the fixing beam parts 254. Thus, the ink never enters the spaces between the adjacent ink-jet recording heads 220. Accordingly, it is possible to prevent deterioration of and damage to the ink-jet recording heads 220 including the piezoelectric elements 300, the drive IC 110 and the like due to the ink. Moreover, the ink droplet ejecting surface of the ink-jet recording head 220 and the fixing plate 250 are bonded together with no space therebetween. Thus, it is possible to prevent a medium to be recorded on from entering the space and deformation of the fixing plate 250 and paper jams can be prevented.

Moreover, on the fixing plate 250 as described above, the plurality of ink-jet recording heads 220 are positioned and fixed. Such positioning can be performed by use of a positioning jig made of a plate member having transparency such as glass, for example. Here, description will be given of a method for manufacturing the fixing plate 250 using the positioning jig and the ink-jet recording head 220. Note that FIGS. 6A to 6C are plan views showing the method for manufacturing the fixing plate and the ink-jet recording head.

Figure 6A:
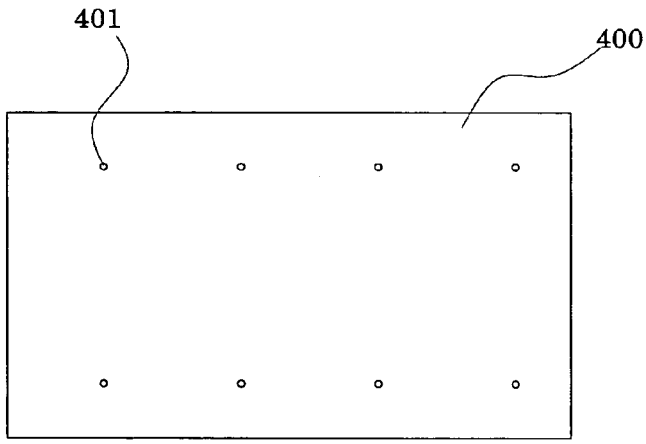
FIGS. 6A to 6C are plan views showing a manufacturing process of the head unit according to embodiment 1.
Figure 6B:
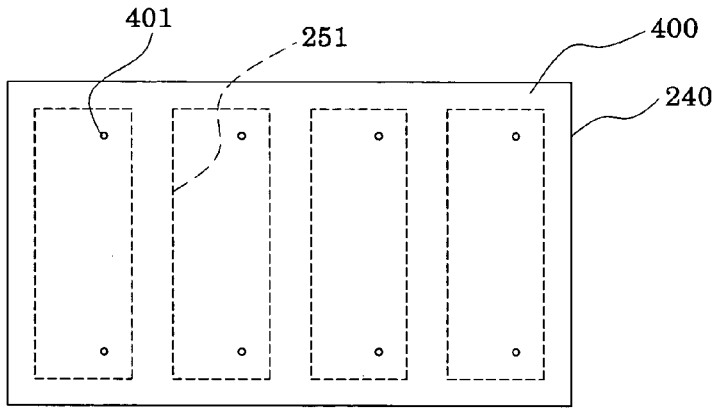

As shown in FIG. 6A, the positioning jig 400 is made of a plate member having transparency such as glass. In the positioning jig 400, the alignment marks 401 for positioning predetermined nozzle orifices 21 of the respective nozzle arrays 21A are provided at predetermined positions. First, as shown in FIG. 6B, a periphery of the positioning jig 400 and a periphery of the fixing plate 250 are aligned with each other and the fixing plate 250 is positioned on the positioning jig 400. In this event, the periphery of the positioning jig 400 is provided to have the same size as that of the periphery of the fixing plate 250 and the alignment marks 401 are provided at predetermined positions with respect to the periphery.

Figure 6C:
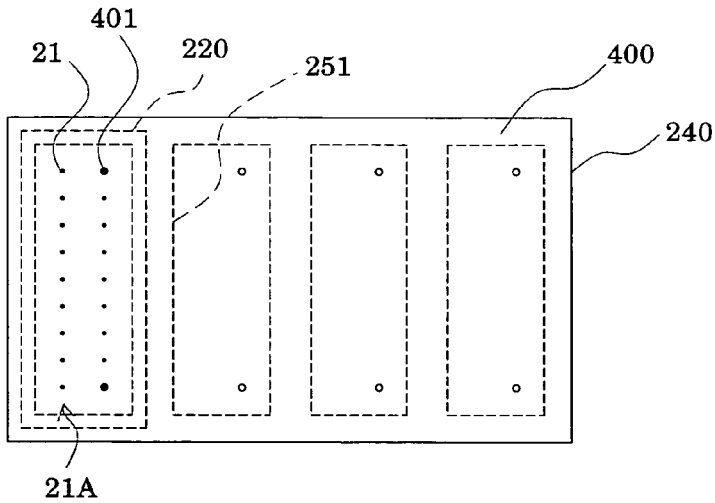

Next, as shown in FIG. 6C, by looking at the positioning jig 400 from the opposite side to the fixing plate 250, the nozzle orifice 21 of the nozzle array 21A of the first ink-jet recording head 220 is positioned at the alignment mark 401. In this event, although not shown in FIG. 6C, an adhesive is previously applied to a joint surface of the fixing plate 250 to be joined to the ink-jet recording head 220 and the nozzle arrays 21A are positioned. At the same time, the first ink-jet recording head 220 and the fixing plate 250 are joined.

Note that, for example, when the ink-jet recording head 220 is fixed directly to the cover head 240, the cover head 240 cannot be formed of a thin material in order to protect the ink-jet recording head 220 from shocks of capping, wiping and the like. Accordingly, the distance between the nozzle orifice 21 of the ink-jet recording head 220 and the alignment mark 401 is increased. When the nozzle orifice 21 and the alignment mark 401 are distant from each other as described above, positioning thereof is difficult and positioning accuracy cannot be improved. However, in this embodiment, since the ink-jet recording head 220 is positioned and fixed to the fixing plate 250, the fixing plate 250 can be formed to be thin. Thus, the distance between the nozzle orifice 21 and the alignment mark 401 can be shortened and positioning of the nozzle orifice 21 and the alignment mark 401 can be easily and accurately performed.

Moreover, the cover head 240 is formed to have a box shape so as to cover the ink-jet recording head 220 in order to protect the ink-jet recording head 220 from shock and the like. Thus, for example, when the ink-jet recording head 220 is positioned and fixed directly to the cover head 240, handling of the ink-jet recording head 220 is poor in the cover head 240 and it is difficult to perform positioning of the ink-jet recording head 220 with high accuracy. Moreover, for example, even if the ink-jet recording head 220 is formed to have a size so as to protrude from a sidewall portion 245 of the cover head 240 in order to improve handling of the ink-jet recording head 220 inside the cover head 240, the ink-jet recording head 220 is not covered with the cover head 240. Thus, the cover head 240 cannot protect the ink-jet recording head 220. Moreover, the ink-jet recording head 220 grows in size. Meanwhile, in this embodiment, since the ink-jet recording head 220 is fixed to the fixing plate 250 made of a flat plate, positioning of the ink-jet recording head 220 can be performed with high accuracy without hindering the handling of the ink-jet recording head 220 in the positioning thereof.

Note that, as an adhesive for bonding the fixing plate 250 and the ink-jet recording head 220, a thermosetting adhesive and a UV cure adhesive can be used as described above. Here, in the case of using the thermosetting adhesive, the fixing plate 250 and the ink-jet recording head 220 are made to abut on each other after the adhesive is applied to the fixing plate 250. Thereafter, the adhesive is hardened while pressurizing the fixing plate 250 and the ink-jet recording head 220 at a predetermined pressure. Accordingly, the two members are bonded together. Meanwhile, in the case of using the UV cure adhesive, after the adhesive is applied to a joint surface of the fixing plate 250, ultraviolet rays are irradiated in a state where the fixing plate 250 and the ink-jet recording head 220 abut on each other. Accordingly, the adhesive is hardened and the two members are bonded together. In this event, unlike the thermosetting adhesive, the UV cure adhesive is not required to be hardened while pressurizing the fixing plate 250 and the ink-jet recording head 220 at the predetermined pressure. Thus, a positional shift between the ink-jet recording head 220 and the fixing plate 250 due to pressurization is prevented and the two members can be bonded together with high accuracy. Moreover, bonding using the UV cure adhesive has a relatively weak bonding strength. Thus, after the fixing plate 250 and the ink-jet recording head 220 are bonded by use of the UV cure adhesive, areas around corners and the like, which are defined by the ink-jet recording head 220 and the fixing plate 250, may be fixed by use of the thermosetting adhesive. Consequently, the fixing plate 250 and the ink-jet recording head 220 can be firmly bonded with high accuracy and reliability can be improved.

Thereafter, by repeating the step shown in FIG. 6C, the plurality of ink-jet recording heads 220 and the fixing plate 250 are sequentially positioned and fixed. As described above, the fixing plate 250 and the plurality of nozzle arrays 21A are positioned and the two members are bonded. Thus, positioning of the fixing plate 250 and the nozzle arrays 21A can be performed with high accuracy. Moreover, relative positioning between the respective nozzle arrays 21A of the adjacent ink-jet recording heads 220 can be performed with high accuracy. Furthermore, the ink-jet recording heads 220 are made to abut on the fixing plate 250 made of a flat plate and fixed thereto. Thus, just by fixing the ink-jet recording heads 220 to the fixing plate 250 made of the flat plate, relative positioning of the plurality of ink-jet recording heads 220 in an ink droplet ejecting direction is performed. Consequently, it is not required to perform alignment of the plurality of ink-jet recording heads 220 in the ink droplet ejecting direction. Moreover, failure of landing positions of ink droplets can be surety prevented. Although the plate 250 is referred to as a "fixing plate", it will be understood that its function of helping align and position the ink-jet recording heads 220 may be thought of in a more general sense as being performed by an alignment member.

Meanwhile, as shown in FIGS. 1 and 2, in the head unit 200, the cover head 240 having a box shape so as to cover the plurality of ink-jet recording heads 220 is provided on the fixing plate 250 at the side opposite the ink-jet recording heads 220. This cover head 240 includes: a fixing part 242 in which openings 241 are provided so as to correspond to the exposure openings 251 of the fixing plate 250; and a sidewall part 245 provided so as to bend along the periphery of the fixing plate 250 at sides of the ink droplet ejecting surfaces of the ink-jet recording heads 220.

In this embodiment, the fixing part 242 includes: a frame portion 243 provided so as to correspond to the fixing frame part 253 of the fixing plate 250; and beam portions 244 which are provided so as to correspond to the fixing beam parts 254 of the fixing plate 250 and divide the openings 241. Moreover, the fixing part 242 including the frame portion 243 and the beam portions 244 as described above is joined to the junction 252 of the fixing plate 250.

As described above, the ink droplet ejecting surfaces of the ink-jet recording heads 220 and the cover head 240 are joined with no space therebetween. Thus, it is possible to prevent the medium to be recorded on from entering the space and the deformation of the cover head 240 and paper jams can be prevented. Moreover, the sidewall part 245 of the cover head 240 covers peripheral portions of the plurality of ink-jet recording heads 220. Thus, it is possible to surely prevent the ink from running around the sides of the ink-jet recording heads 220.

For the cover head 240 as described above, for example, a metal material such as stainless steel can be used. The cover head 240 may be formed of a metal plate by press working or may be formed by molding. Moreover, by forming the cover head 240 by use of an electric conductive metal material, the cover head 240 can be grounded. Furthermore, in order to protect the ink-jet recording heads 220 from shocks of wiping, capping and the like, the cover head 240 is required to have a certain degree of strength. Thus, the cover head 240 is required to be relatively thick. Note that, in this embodiment, the cover head 240 is formed to have a thickness of 0.2 mm.

Note that junction of the cover head 240 and the fixing plate 250 is not particularly limited. For example, the two members are joined together by use of a thermosetting epoxy adhesive.

Moreover, in the fixing part 242, flange portions 246 are provided, in which fixing holes 247 for positioning and fixing the cover head 240 to other members are provided. Each of the flange portions 246 is provided to be bent so as to protrude in the same direction as a surface direction of the ink droplet ejecting surface from the sidewall part 245. In this embodiment, as shown in FIGS. 2 and 3, the cover head 240 is fixed to the cartridge case 210 that is the retaining member retaining the ink-jet recording heads 220 and the head cases 230.

To be more specific, as shown in FIGS. 2 and 3, in the cartridge case 210, protrusions 215 are provided, which are inserted into the fixing holes 247 of the cover head 240 while protruding toward the ink droplet ejecting surface. These protrusions 215 are inserted into the fixing holes 247 of the cover head 240 and tip portions of the protrusions 215 are heated and deformed. Thus, the cover head 240 is fixed to the cartridge case 210. Since the protrusions 215 provided in the cartridge case 210 as described above are formed to have outside diameters smaller than those of the fixing holes 247 of the flange portions 246, the cover head 240 can be positioned in the surface direction of the ink droplet ejecting surface and fixed to the cartridge case 210.

Moreover, the cover head 240 as described above and the fixing plate 250 in which the plurality of ink-jet recording heads 220 are joined are fixed by positioning the fixing holes 247 of the cover head 240 and the plurality of nozzle arrays 21A. Here, positioning of the fixing holes 247 of the cover head 240 and the plurality of nozzle arrays 21A can be performed by use of the positioning jig 400 described above. Alternatively, the cover head 240 may be positioned and fixed simultaneously with positioning and fixing of the fixing plate 250 and the plurality of ink-jet recording heads 220.

Figure 7:
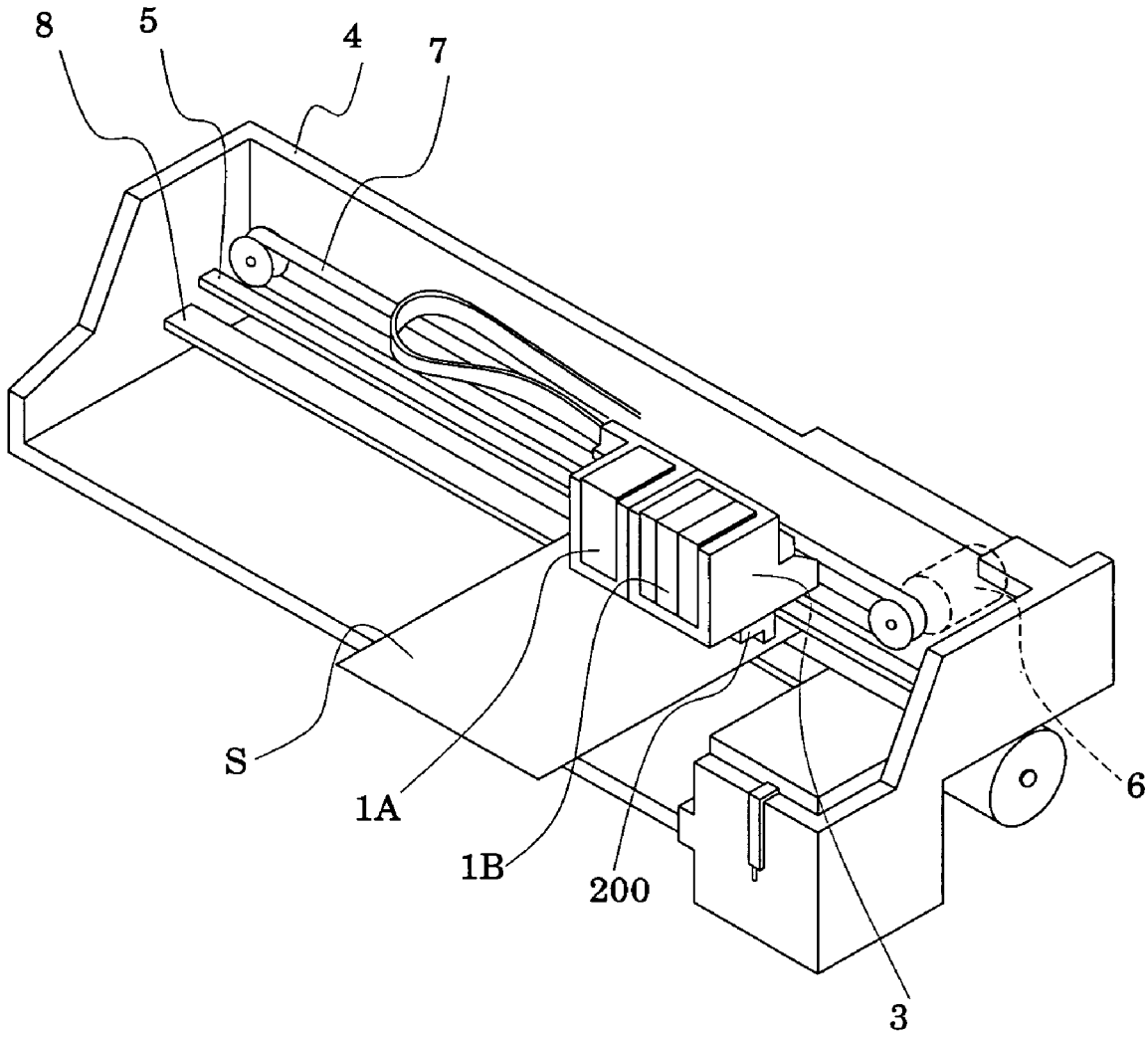
FIG. 7 is a schematic view of an ink-jet recording apparatus according to embodiment 1.

The head unit 200 as described above is mounted on an ink-jet recording apparatus. FIG. 7 is a schematic view showing an example of the ink-jet recording apparatus. As shown in FIG. 7, in the head unit 200 having the ink-jet recording heads, cartridges 1A and 1B constituting ink supply means are provided so as to be detachable. A carriage 3 mounting the head unit 200 thereon is provided on a carriage shaft 5 attached to an apparatus body 4 so as to be movable in an axial direction. These recording head units 1A and 1B, for example, eject a black ink composition and a color ink composition, respectively.

Accordingly, driving force of a drive motor 6 is transmitted to the carriage 3 through a plurality of gears (not shown) and a timing belt 7. Thus, the carriage 3 mounting the head unit 200 thereon moves along the carriage shaft 5. Meanwhile, a platen 8 is provided along the carriage shaft 5 in the apparatus body 4 and a recording sheet S that is a medium to be recorded on such as paper, which is fed by an unillustrated paper feeding roller or the like, is conveyed on the platen 8.

Embodiment 2

Figure 8:
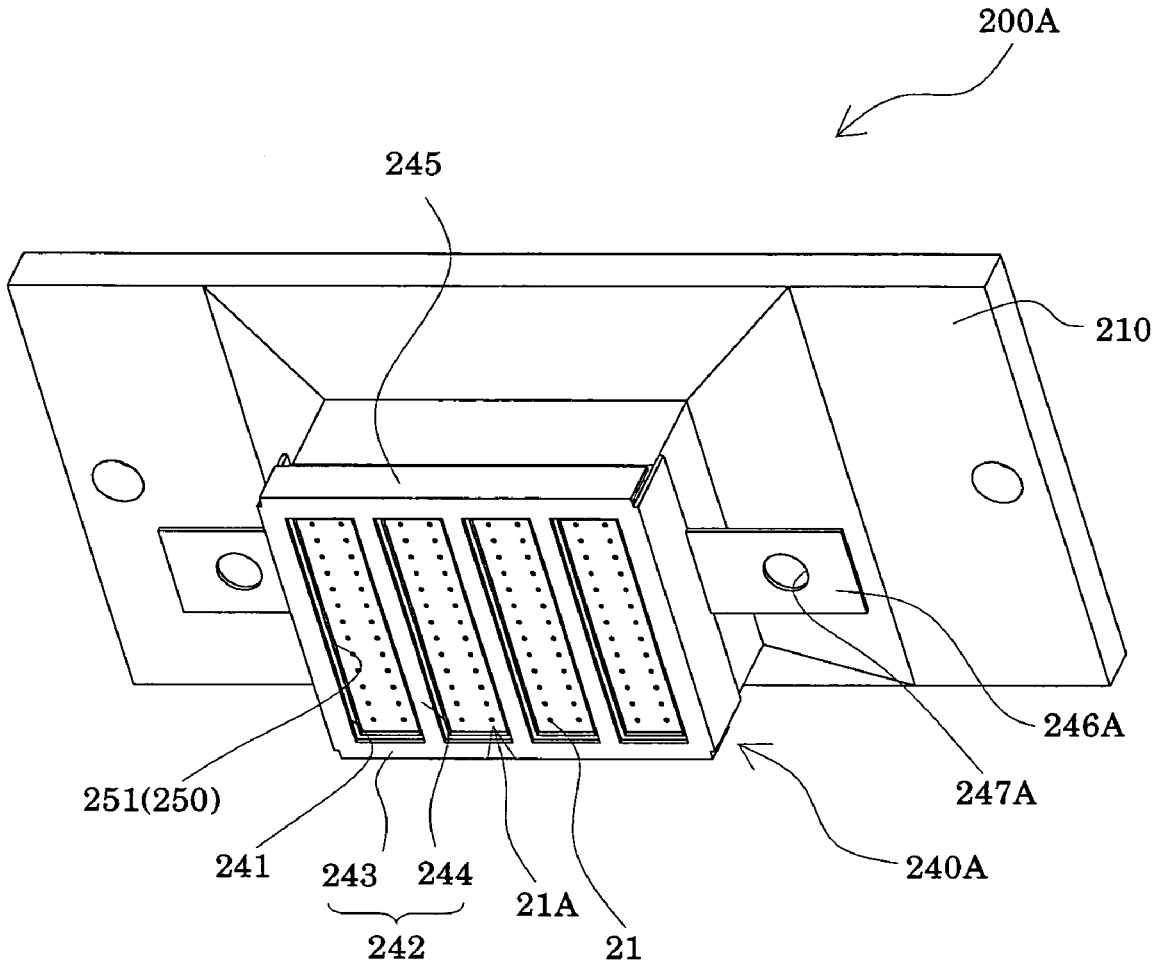
FIG. 8 is a perspective assembly view of a head unit according to embodiment 2.
Figure 9:
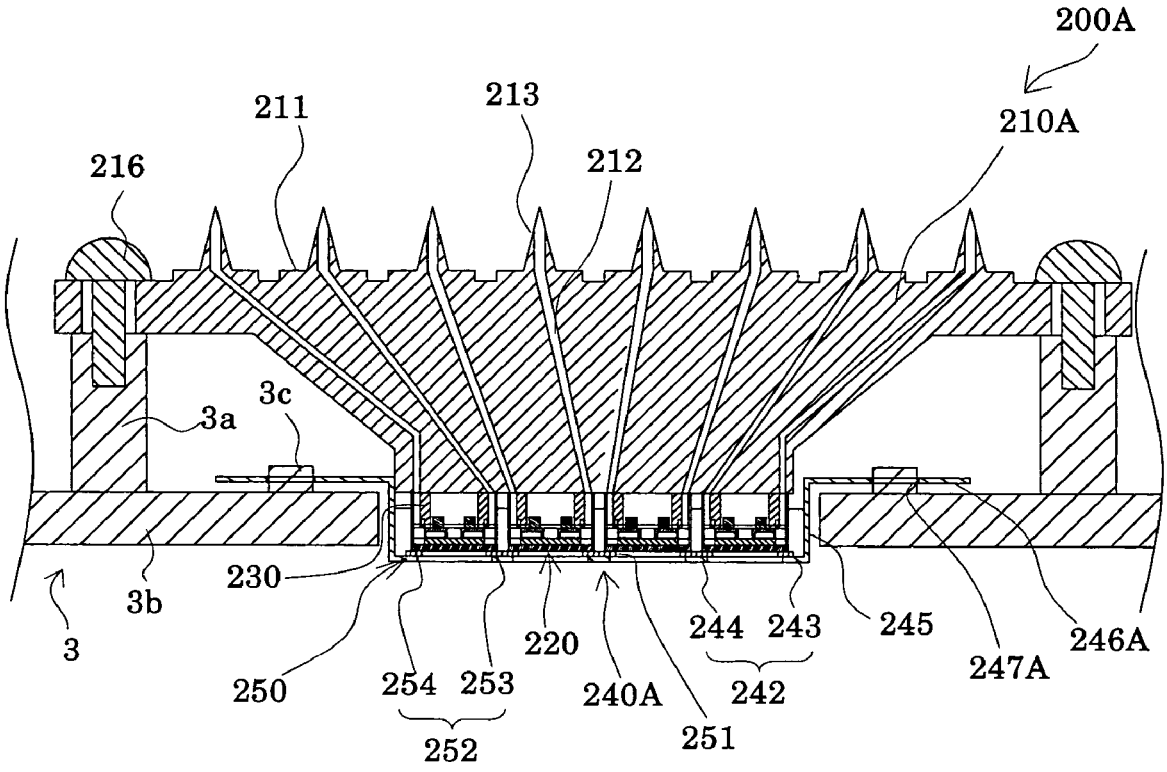
FIG. 9 is a cross-sectional view of main part of the head unit according to embodiment 2.

FIG. 8 is a perspective assembly view of an ink-jet recording head unit according to embodiment 2 of the present invention. FIG. 9 is a cross-sectional view of main part of the ink-jet recording head unit. As shown in FIGS. 8 and 9, in a head unit 200A of this embodiment, a cover head 240A and a cartridge case 210A are fixed to a carriage 3.

To be more specific, the carriage 3 includes: a cartridge case supporting part 3*a* to which the cartridge case 210A is fixed by means of screw members 216; and a cover head supporting part 3*b* to which the cover head 240A is fixed. In the cover head supporting part 3*b*, protrusions 3*c* to be inserted into fixing holes 247A of flange portions 246A of the cover head 240A are provided. Moreover, the protrusions 3*c* are inserted into the fixing holes 247A of the flange portions 246A and tip portions of the protrusions 3*c* are heated and deformed. Thus, the cover head 240A is fixed to the carriage 3.

As described above, the cover head 240A, in which the fixing holes 247A and the nozzle arrays 21A are accurately positioned, is fixed directly to the carriage 3 by use of the fixing holes 247A. Accordingly, positioning of the carriage 3 and the nozzle arrays 21A can be easily and accurately performed. Moreover, it is not required to separately perform the positioning of the carriage 3 and the nozzle arrays 21A. Thus, the manufacturing process can be simplified and manufacturing time can be shortened.

Needless to say, as in the case of embodiment 1 described above, by joining the cover head 240A to the ink droplet ejecting surface of the ink-jet recording head 220, it is possible to prevent the ink from remaining on the ink droplet ejecting surface. Moreover, the ink never runs around the ink-jet recording head 220. Thus, deterioration of and damage to the ink-jet recording head 220 due to the ink can be prevented. Moreover, since there is no space between the ink droplet ejecting surface and the cover head 240A, deformation of the cover head and paper jams can be prevented.

Other Embodiments

Although the embodiments of the present invention have been described above, the present invention is not limited to those described above. For example, on the ink droplet ejecting surface of the nozzle plate 20 according to embodiments 1 and 2 described above, a water-repellent film for improving water repellency is actually formed. As the water-repellent film described above, for example, a metal film can be used, although not particularly limited thereto. Such a metal film lowers adhesive power of an adhesive when the fixing plate 250 is joined to the ink droplet ejecting surface. Thus, it is preferable that such a metal film is provided only in a region exposed by the openings 251 of the fixing plate 250. Moreover, such a metal film can be accurately formed to have a predetermined thickness by eutectoid plating.

Moreover, in embodiments 1 and 2 described above, the fixing frame part 253 and the fixing beam parts 254 are provided in the junction 252 of the fixing plate 250. However, without being limited thereto, the junction 252 of the fixing plate 250 only needs to be provided at least at the both end sides of the nozzle arrays 21A. For example, in the case of providing the junction 252 only at the both end sides of the nozzle arrays 21A, by covering spaces between the adjacent ink-jet recording heads 220 with the cover head 240, the ink never enters the spaces between the adjacent ink-jet recording heads 220. Thus, deterioration of and damage to the ink-jet recording heads 220 due to the ink can be prevented.

Furthermore, in embodiments 1 and 2 described above, the cover heads 240 and 240A are joined to the surface of the fixing plate 250, which is opposite the ink-jet recording heads 220. However, without being particularly limited thereto, for example, the cover head may be provided so as to have a predetermined distance from the fixing plate 250 without being joined thereto or may be provided so as to abut thereon. In either case, since the plurality of ink-jet recording heads 220 are positioned and fixed to the fixing plate 250, relative positioning of the plurality of nozzle arrays 21A can be accurately performed.

Moreover, in embodiments 1 and 2 described above, the sidewall part 245 and the flange portions 246 and 246A having the fixing holes 247 and 247A are provided in the cover head 240 and 240A. However, the sidewall part 245 and the flange portions 246 and 246A having the fixing holes 247 and 247A are not necessarily required. Thus, even if the sidewall part 245 and the flange portions 246 and 246A having the fixing holes 247 and 247A are not provided, it is possible to prevent the ink from remaining on the ink droplet ejecting surface. In addition, the plurality of ink-jet recording heads can be easily joined in a state where relative positioning of the nozzle arrays 21A is accurately performed in the cover head.

Moreover, in embodiments 1 and 2 described above, the ink-jet recording head 220 of a flexural oscillation type has been described as an example. However, the present invention is not limited thereto. It is needless to say that the present invention is applicable to a head unit having ink-jet recording heads with various structures, including, for example: an ink-jet recording head of a longitudinal oscillation type, in which piezoelectric materials and electrode forming materials are alternately stacked on each other and elongated and contracted in an axial direction; an ink-jet recording head which ejects ink droplets by using bubbles generated by heating of heater elements or the like; and the like.

Note that the head unit having the ink-jet recording heads ejecting inks as the liquid jet heads and the ink-jet recording apparatus have been described as an example. However, the present invention aims widely at general liquid jet head units having liquid jet heads and liquid jet devices. As the liquid jet head, for example, enumerated are: a recording head used in an image recording apparatus such as a printer; a color material jet head used for manufacturing color filters of a liquid crystal display and the like; an electrode material jet head used for forming electrodes of an organic EL display, a field emission display (FED) and the like; a bio-organic matter jet head used for manufacturing biochips; and the like.

What is claimed is:

1. A liquid jet head unit comprising:

a liquid jet head having nozzle arrays including arranged nozzle orifices which eject liquid droplets from a liquid droplet ejecting surface;

a head case fixed to a liquid supply port side of the liquid jet head;

a cover head provided on a liquid droplet ejecting surface side of the liquid jet head; and a fixing plate fixed to the liquid droplet ejecting surface of the liquid jet head, such that the fixing plate is provided between the liquid jet head and the cover head, the fixing plate having a junction that defines exposure openings having the nozzle orifices exposed therein, wherein, by fixing the liquid droplet ejecting surface of the liquid jet head and the fixing plate, a plurality of liquid jet heads are positioned and fixed to the fixing plate.

2. The liquid jet head unit according to claim 1, wherein the junction has a fixing frame part provided along a periphery of the liquid droplet ejecting surface.

3. The liquid jet head unit according to claim 1, wherein the junction has a fixing beam part of which is provided to extend between the adjacent liquid jet heads and divides the exposure opening.

4. The liquid jet head unit according to claim 1, wherein, in the liquid jet head, pin insertion holes are provided, into which pins for positioning in assembly of individual members included in the liquid jet head are inserted, and the fixing plate seals the pin insertion holes.

5. The liquid jet head unit according to claim 1, wherein the fixing plate is made of a metal material.

6. The liquid jet head unit according to claim 1, wherein the cover head is provided without being joined to a surface of the fixing plate, which is opposite the liquid jet head.

7. The liquid jet head unit according to claim 1, wherein the cover head is joined to at least both ends of the nozzle arrays on a surface of the fixing plate, which is opposite the liquid jet head.

8. The liquid jet head unit according to claim 1, wherein the cover head has a sidewall part provided to extend to a peripheral portion of the liquid droplet ejecting surface.

9. The liquid jet head unit according to claim 8, wherein the sidewall part is provided across the peripheral portion of the liquid droplet ejecting surface.

10. The liquid jet head unit according to claim 1, wherein fixing holes for positioning and fixing the cover head to another member are provided in the cover head, and the cover head and the liquid jet heads are joined together by positioning the fixing holes and the plurality of nozzle arrays.

11. The liquid jet head unit according to claim 10, further comprising:

a retaining member which retains the head case, wherein the fixing holes of the cover head are positioned and fixed to the retaining member.

12. The liquid jet head unit according to claim 10, further comprising:

a retaining member which retains the head case and is fixed to a carriage moving in a scanning direction, wherein the fixing holes of the cover head are positioned and fixed to the carriage.

13. The liquid jet head unit according to claim 1, wherein a water-repellent film is provided on the liquid droplet ejecting surface of the liquid jet head.

14. The liquid jet head unit according to claim 13, wherein the water-repellent film is formed only in a region exposed by the exposure opening of the liquid droplet ejecting surface.

15. The liquid jet head unit according to claim 1, wherein the fixing plate is made of a flat plate.

16. A liquid jet device, comprising:

the liquid jet head unit according to any one of claims 1 to 15.

17. A method for manufacturing a liquid jet head unit, comprising the steps of:

positioning a liquid jet head, which has nozzle arrays including arranged nozzle orifices ejecting liquid droplets and has its liquid supply port side fixed to a head case, to a fixing plate which defines an exposure opening, in which the nozzle orifices are exposed, and has a junction joined to at least both ends of the nozzle arrays on a liquid droplet ejecting surface of the liquid jet head;

joining the junction to the liquid droplet ejecting surface;

positioning and fixing a plurality of the liquid jet heads to the fixing plate in common; and providing a cover head on the liquid droplet ejecting surface side.

18. A liquid jet head unit comprising: a liquid jet head having a nozzle plate with nozzle arrays including arranged nozzle orifices which eject liquid droplets from a liquid droplet ejecting surface of the nozzle plate; a head case fixed to a liquid supply port side of the liquid jet head; and alignment member having a junction that defines exposure openings having the nozzle orifices exposed therein and fixed to the liquid droplet ejecting surface of the nozzle plate, wherein, by fixing the alignment member to the liquid droplet ejecting surface of the nozzle plate of the liquid jet head, a plurality of liquid jet heads are positioned and aligned by the alignment member, wherein the alignment member comprises a cover head.

19. The liquid jet head unit according to claim 1, wherein the liquid jet head has a nozzle plate which has a flat portion having the nozzle arrays including the arranged nozzle orifices ejecting liquid droplets from the liquid ejecting surface, and the liquid droplet ejecting surface of the flat portion of the nozzle plate is joined to the fixing plate.

* * * * *

UNITED STATES PATENT AND TRADEMARK OFFICE

CERTIFICATE OF CORRECTION

PATENT NO. : 7,484,828 B2
APPLICATION NO. : 10/927389
DATED : February 3, 2009
INVENTOR(S) : Hiroshige Owaki It is certified that error appears in the above-identified patent and that said Letters Patent is hereby corrected as shown below:

Title page,

Under "Inventor" (item 75), please add the following inventor:

Yoshinao Miyata, Nagano-ken (JP)

Signed and Sealed this

Fourteenth Day of July, 2009

JOHN DOLL
*Acting Director of the United States Patent and Trademark Office*